US005704268A

United States Patent [19]

Hinchliffe

[11] Patent Number: 5,704,268

[45] Date of Patent: Jan. 6, 1998

[54] ELECTRO-HYDRAULIC SHOWER OSCILLATOR FOR PAPERMAKING

[75] Inventor: James Peter Hinchliffe, Hartford, N.Y.

[73] Assignee: Thermo Fibertek Inc., Waltham, Mass.

[21] Appl. No.: 507,154

[22] Filed: Jul. 26, 1995

[51] Int. Cl.[6] ..... F01B 25/26; F15B 13/16

[52] U.S. Cl. ..... 91/1; 91/361; 92/5 R

[58] Field of Search ..... 91/1, 361; 92/5 R

[56] References Cited

U.S. PATENT DOCUMENTS

| | | | |
|---|---|---|---|
| 3,410,177 | 11/1968 | Roess et al. | 91/361 |
| 3,654,549 | 4/1972 | Maurer et al. | 92/5 R X |
| 3,739,605 | 6/1973 | Baker | 68/20 |
| 4,281,584 | 8/1981 | Onken et al. | 91/1 |
| 4,328,449 | 5/1982 | Calligaris | 318/571 |
| 4,329,636 | 5/1982 | Uchida et al. | 318/721 |
| 4,335,342 | 6/1982 | Tholome | 318/627 |
| 4,359,677 | 11/1982 | Dennon | 318/687 |
| 4,460,324 | 7/1984 | Van Appledorn | 91/361 X |
| 4,534,706 | 8/1985 | Palm et al. | 417/17 |
| 4,598,238 | 7/1986 | Scarano | 318/25 X |
| 4,656,457 | 4/1987 | Brausfeld et al. . | |
| 4,669,359 | 6/1987 | Shiba | 91/361 |
| 4,700,610 | 10/1987 | Bauer et al. | 91/1 X |
| 4,749,936 | 6/1988 | Taplin | 91/361 X |
| 4,757,244 | 7/1988 | Iwamoto et al. | 318/652 |
| 4,952,916 | 8/1990 | Taplin | 91/361 X |
| 4,973,893 | 11/1990 | Secretan | 318/280 |
| 5,117,633 | 6/1992 | Bayer et al. | 91/361 X |
| 5,369,343 | 11/1994 | Niemela | 318/280 |
| 5,457,959 | 10/1995 | Langguth et al. | 91/361 X |
| 5,458,047 | 10/1995 | McCormick | 91/361 |

FOREIGN PATENT DOCUMENTS

| | | | |
|---|---|---|---|
| 2914083 | 10/1979 | Germany | 92/5 R |
| 157388 | of 1982 | Japan . | |
| 1373912 | 2/1988 | U.S.S.R. | 92/5 R |

*Primary Examiner*—Hoang Nguyen

*Attorney, Agent, or Firm*—Kane, Dalsimer, Sullivan, Kurucz, Levy, Eisele and Richard, LLP

[57] ABSTRACT

The apparatus is an oscillator for a showerhead to keep the forming fabric of a papermaking machine clean and open. A hydraulic cylinder is formed with a piston cup assembly dividing the cylinder into first and second fluid chambers. The piston cup assembly is coupled to a magnet and a driveshaft, the driveshaft being coupled, in turn, to the showerhead to be oscillated. A four-way valve is used to direct fluid from a pressurized external source alternately into said first and second fluid chambers thereby causing reciprocation of the driveshaft. The position of the magnet, and hence the driveshaft and showerhead, is monitored by a transducer which sends position and rate signals to a microprocessor-based controller. The microprocessor-based controller sends a signal to the four-way valve to direct which of said first and second fluid chambers receives fluid from the pressurized source in order to achieve the desired parameters of reciprocation. Additionally, the microprocessor-based controller provides an alarm signal should the driveshaft rate drop below a preset value.

9 Claims, 1 Drawing Sheet

ELECTRO-HYDRAULIC SHOWER OSCILLATOR FOR PAPERMAKING

BACKGROUND OF THE INVENTION

1. Field of the Invention

This invention pertains to an electro-hydraulic shower oscillator for papermaking. More particularly, this invention is used to oscillate the shower of a papermaking apparatus in order to keep the papermaking fabrics clean and open.

2. Description of the Prior Art

Highly engineered fabrics are used in the papermaking process to remove water from the paper stock and resulting paper sheet during the transportation thereof through the forming, pressing and drying sections of the papermaking machine. It is well-known that the proper function of these fabrics depends heavily on keeping these fabrics clean and open. However, with the increased use of recycled fiber, it has become increasingly difficult to clean these fabrics.

The accepted method of cleaning fabrics in the papermaking process is showering. For reasons such as uniform distribution of fluids and proper cleaning, these shower systems often need to be oscillated.

There are three general categories of prior art papermaking machine shower oscillators. Firstly, there is a crank-arm type incorporating a motor drive with an eccentric camshaft. Secondly, there is the fluid-powered type incorporating water, air, or oil-powered cylinders. Thirdly, there is the electro-mechanical type incorporating a gearmotor driven ballscrew, acme thread, or leadscrew, an example is disclosed in U.S. Pat. No. 4,598,238 to Scarano entitled "Electro-Mechanical Shower Oscillator for Papermaking Machine".

Prior art hydraulic oscillators use cylinders powered by a fluid such as water, air or oil. Many utilize an internal throttle rod assembly to activate a valving mechanism at both ends of the stroke. Examples of this include the AES-880 and the Thermo Electron-Posi Stroke oscillators manufactured by AES Engineered Systems, 436 Quaker Road, P.O. Box 7010, Queensbury, N.Y. 12804.

Other oscillators utilize external reversing mechanisms. The Stamm oscillator manufactured by Heinrich Stamm Worms Am Rhein, Germany incorporates an external pilot valve that is actuated at both ends of its stroke by a rod coupled to the output shaft. Such oscillators utilize mechanical reversing arrangements which by nature are susceptible to wear, failure, and/or damage. Another undesirable aspect of these designs is that the unit requires mechanical alteration to change the oscillator stroke length. In many cases, this requires a partial, if not complete, disassembly of the oscillator to adjust these limits.

Similarly, the oscillator disclosed in International Publication No. WO 90/08904 uses a ballscrew to convert the linear motion of the driveshaft to rotary motion. This rotary motion is then monitored by a photocell to control the oscillator. Again, the major drawback of this design is that the ballscrew device used to relay shaft position is mechanical and subject to wear and/or failure.

Other references include the following U.S. patents:

U.S. Pat. No. 5,369,343
U.S. Pat. No. 4,973,893
U.S. Pat. No. 4,757,244
U.S. Pat. No. 4,598,238
U.S. Pat. No. 4,534,706
U.S. Pat. No. 4,359,677

U.S. Pat. No. 4,335,342
U.S. Pat. No. 4,329,636
U.S. Pat. No. 4,328,449
U.S. Pat. No. 3,739,605

As well as Japanese Patent No. 58-157338.

OBJECTS AND SUMMARY OF THE INVENTION

It is therefore an object of this invention to provide a shower oscillator for a papermaking machine to keep the fabrics clean and open.

It is therefore a further object of this invention to provide a shower oscillator for a papermaking machine which will operate reliably at a wide range of speeds, including slow speeds.

It is therefore a further object of this invention to provide a shower oscillator for a papermaking machine that incorporates a method to monitor drive shaft position which is not susceptible to wear-related failure.

It is therefore a yet further object of this invention to provide a shower oscillator for a papermaking machine with a variable stroke length and variable stroke location without requiring mechanical adjustments or disassembly of the oscillator to vary or adjust the stroke length or location.

These and other objects are achieved by providing a shower oscillator which is hydraulically driven. A four-way valve in response to a controller signal alternates the hydraulic driving fluid flow path so that the hydraulic driving fluid first drives the shower oscillator in a first direction, and then in a second direction opposite to the first direction thereby achieving oscillation. A magnet travels with the piston cup/driveshaft assembly as the oscillator strokes in and out. By use of a linear displacement transducer, the position of the magnet is monitored and therefore the shaft position and rate are accurately reported to the controller without physical coupling or actuation by the piston cup/driveshaft assembly. This lack of physical coupling eliminates the wear, failure, and/or other damage which is associated with a mechanical reversing arrangement.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
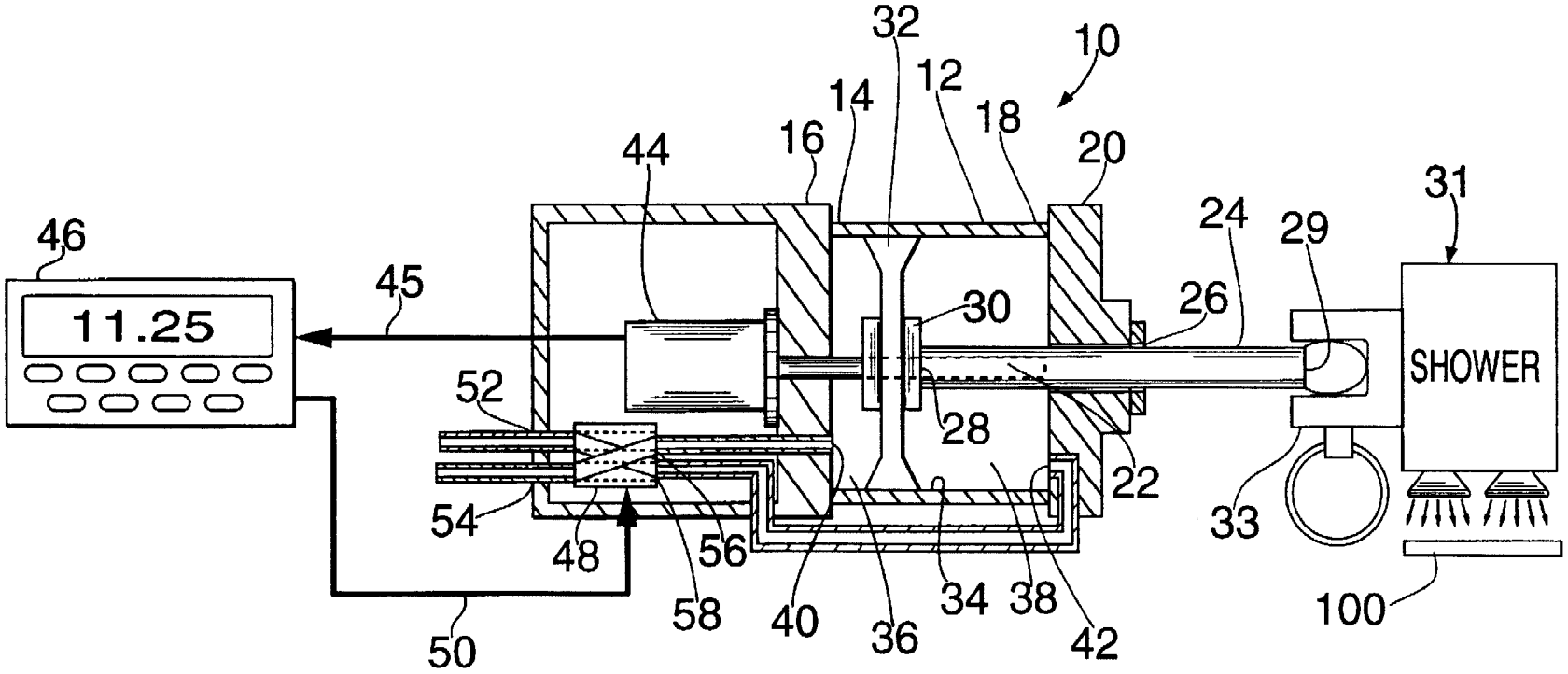
FIG. 1 is a schematic, partially in cross section, of the shower oscillator of the present invention.

Referring now to the drawing in detail, one sees that FIG. 1 is a schematic of the shower oscillator apparatus 10 of the present invention.

Hydraulic cylinder 12 is capped and sealed at first end 14 by transducer cap 16 and at second end 18 by driveshaft guide cap 20. A fixed linear displacement transducer shaft 22 extends along the longitudinal axis of hydraulic cylinder 12 and is fixed in place by transducer cap 16. Driveshaft 24 is at least partially hollow so as to be concentrically outward from fixed linear displacement transducer shaft 22 and form an axially sliding or reciprocating relationship therewith. Similarly, driveshaft 24 forms a liquid-tight axial sliding or reciprocating relationship through driveshaft guide aperture 26 which is central within driveshaft guide cap 20.

Proximal end 28 of driveshaft 24 is affixed to magnet 30 and axially reciprocating piston cup 32 which hydraulically sealingly engages the interior walls 34 of hydraulic cylinder 12. Distal end 29 of driveshaft 24 is affixed by way of a pull-pin configuration 33 to showerhead 31 which reciprocates in unison with driveshaft 24. Showerhead 31 is used to keep fabrics 100 in a papermaking apparatus (not shown) clean and open from debris.

Axially reciprocating piston cup assembly 32 divides the interior of hydraulic cylinder into a first fluid chamber 36 and a second fluid chamber 38. The respective sizes of fluid chambers 36, 38 are varied by the axial movement of piston cup assembly 32 and the resulting reciprocation of driveshaft 24.

Transducer cap 16 includes a first fluid aperture 40 through which fluid can be injected into first fluid chamber 36 to expand first fluid chamber 36 and thereby extend driveshaft 24. Likewise, first fluid aperture 40 serves as a drain when driveshaft 24 is being retracted thereby reducing the size of first fluid chamber 36.

Driveshaft guide cap 20 includes a second fluid aperture 42 through which fluid can be injected into second fluid chamber 38 to expand second fluid chamber 38 and thereby retract driveshaft 24. Likewise, second fluid aperture 42 serves as a drain when driveshaft 24 is being extended thereby reducing the size of second fluid chamber 38.

On the side of transducer cap 16 opposite from first fluid chamber 36 is linear displacement transducer 44 (integral with linear displacement transducer shaft 22). Linear displacement transducer 44 uses magnetostrictive principles to sense and monitor the location of magnet 30 in relation to transducer shaft 22 during the reciprocation of driveshaft 24 and magnet 30, thereby sensing and monitoring the position of driveshaft 24 and hence showerhead 31 while remaining free of any moving mechanical connection between driveshaft 24 and linear displacement transducer 44 thereby eliminating the possibility of wear, failure and/or damage inherent in a mechanical reversing arrangement. Linear displacement transducer 44 outputs position and rate signals to microprocessor-based controller 46 via input signal lines 45.

Four-way valve 48 includes a fluid inlet port 52 and a fluid exhaust port 54. Four-way valve 48 further includes secondary port 56 in fluid communication with first fluid aperture 40 and first fluid chamber 36 and secondary port 58 in fluid communication with second fluid aperture 42 and second fluid chamber 38.

Four-way valve 48 has two states, responsive to microprocessor-based controller 46 via output signal lines 50. The first state, as illustrated by horizontal dashed lines in valve 48 on FIG. 1, connects fluid inlet port 52 in fluid communication with secondary port 56 and consequently, first fluid aperture 40 and first fluid chamber 36 and connects fluid exhaust port 54 in fluid communication with secondary port 58 and consequently, second fluid aperture 42 and second fluid chamber 38. In this first state, fluid injected through first fluid aperture 40 via fluid inlet port 52 from an external pressurized source (not shown) fills and expands first fluid chamber 36 thereby extending driveshaft 24, contracting second fluid chamber 38 and exhausting fluid from second fluid chamber 38 through fluid exhaust port 54.

The second state, as illustrated by solid crossed lines in valve 48 on FIG. 1, reverses the connection of secondary ports 56, 58 to ports 52, 54, so that fluid injected through second aperture 42 via fluid inlet port 52 from an external pressurized source (not shown) fills and expands second fluid chamber 38 thereby retracting driveshaft 24, contracting first fluid chamber 36 and exhausting fluid from first fluid chamber 36 through fluid exhaust port 54.

The microprocessor-based controller 46 sends signals to four-way valve 48 via lines 50 which switches four-way valve 48 between the two above-described states at appropriate times as determined by the position of magnet 30 and driveshaft 24 as sensed by transducer 44 thereby resulting in reciprocation or oscillation of driveshaft 24 and showerhead 31.

Microprocessor-based controller 46 performs several functions:

1. Displays position based on an input signal from transducer 44. This is an absolute position signal and is not a series of pulses counted to attain position. Typically these signals are either a 4–20 mA, 0–10 volt D.C., or timed square pulse output. The latter is used by measuring the amount of time between a "send" and "receive" pulse to accurately determine the position of driveshaft 24.

2. Displays driveshaft speed based on a separate input signal from transducer 44. This signal is typically a 4–20 milliamp or 0–10 volt D.C. signal.

3. In addition, microprocessor-based controller 46 could regulate the speed of the driveshaft 24 by throttling the fluid flow of the oscillator apparatus 10 via a positioning valve (not shown). This valve could be adjusted such that variations in speed due to differences in piston surface area could be equalized in critical applications.

4. Allows the user to enter both the inner and outer turnaround locations of showerhead 31 (mechanically affixed to driveshaft 24) without mechanically altering the shower oscillator apparatus 10. This characteristic is unique in that not only can the stroke length be changed but also the stroke location.

5. Provides a low-rate alarm output in the event the oscillator apparatus 10 does not maintain a specified rate.

6. Provides an electrical output via line 50 to reverse the direction of driveshaft 24.

To use apparatus 10, the user inputs the desired operating parameters. This can include turn-around points, showerhead speed, and similar parameters into microprocessor-based controller 46 in order to provide the desired exposure of the fabric 100 to showerhead 31. The user further provides a high-pressure fluid source to fluid input port 52. The appropriate initial position of four-way valve 48 is set by microprocessor-based controller 46. The fluid from fluid input port 52 is directed to the appropriate initial fluid chamber 36 or 38 and exhausted from the other fluid chamber 36 or 38 via fluid exhaust port 54 thereby causing the driveshaft 24 and showerhead 31 to extend or retract from driveshaft guidecap 20. The resulting movement of magnet 30 attached to proximal end 28 of driveshaft 24 is sensed by linear displacement transducer 44, and signals indicating the position and speed are sent to microprocessor-based controller 46 via line 45. When the appropriate position of magnet 30 is reached, microprocessor-based controller 46 sends a signal via line 50 for the four-way valve 48 to reverse the fluid communication paths, thereby reversing the filling and exhausting of fluid chambers 36, 38 thereby causing reciprocation of driveshaft 24 and showerhead 31.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. An apparatus for oscillating a showerhead in a papermaking apparatus, comprising:

a hydraulic cylinder with a means axially sliding therein, thereby dividing said hydraulic cylinder into a first fluid chamber and a second fluid chamber;

a driveshaft coupled at a first end thereof to said sliding means, said driveshaft being coupled to the showerhead;

means for sensing a position of said driveshaft, including:

(a) magnetic means coupled to said driveshaft; and (b) magnetostrictive linear displacement transducer means for determining a position of said magnetic means, thereby determining a position of said driveshaft and said showerhead coupled thereto, and outputting a position signal;

(c) wherein said magnetic means is substantially free of wear surfaces associated with movement of said driveshaft;

said hydraulic cylinder having a first fluid aperture in communication with said first fluid chamber and a second fluid aperture in communication with said second fluid chamber;

means for selectively directing fluid from a pressurized source to a port chosen from said first fluid aperture and said second fluid aperture in response to a fluid direction control signal, wherein said driveshaft and said sliding means are urged in a first direction when the fluid is directed to said first fluid aperture, and wherein said driveshaft and said sliding means are urged in a second direction opposite to said first direction when the fluid is directed to said second fluid aperture; and a control means for receiving said position signal from said transducer means, determining a desired direction of movement of said driveshaft, and outputting said fluid direction control signal to said means for selectively directing fluid.

2. The apparatus for oscillating a showerhead of claim 1 wherein said sliding means comprises a piston cup assembly; said magnet is affixed to said piston cup assembly at said first end of said driveshaft and said showerhead is affixed at a second end of said driveshaft.

3. The apparatus for oscillating a showerhead of claim 2 wherein said means for selectively directing fluid comprises a valve means including a fluid injection port, a fluid exhaust port, a first valve port and a second valve port, said first valve port being in communication with said first fluid aperture of said hydraulic cylinder, and said second valve port being in fluid communication with said second fluid aperture of said hydraulic cylinder; said valve means having a first state and a second state, whereby in said first state:

(a) said fluid injection port is in fluid communication with said first valve port, said first fluid aperture, and said first fluid chamber, and;

(b) said fluid exhaust port is in fluid communication with said second valve port, said second fluid aperture and said second fluid chamber; and whereby in said second state:

(a) said fluid injection port is in fluid communication with said second valve port, said second fluid aperture and said second fluid chamber, and;

(b) said fluid exhaust port is in fluid communication with said first valve port, said first fluid aperture and said first fluid chamber;

whereby in said first state, fluid is injected into said first fluid aperture via said fluid injection port expanding said first fluid chamber thereby urging said piston cup and said driveshaft in said first direction, and in said second state, fluid is injected into said second fluid aperture via said fluid injection port expanding said second fluid chamber thereby urging said piston cup and said driveshaft in said second direction.

4. The apparatus for oscillating a showerhead of claim 3 wherein said hydraulic cylinder is axially bounded by a first cap and a second cap, and wherein said driveshaft extends through an aperture formed in said second cap along a longitudinal axis of said hydraulic cylinder.

5. The apparatus for oscillating a showerhead of claim 4 wherein said transducer includes a fixed linear displacement transducer extending from said first cap along the longitudinal axis of said hydraulic cylinder and wherein said fixed linear displacement transducer senses a position of said driveshaft.

6. The apparatus for oscillating a showerhead of claim 5 wherein said driveshaft includes an at least partially hollow axial portion and said fixed linear displacement transducer extends within said at least partially hollow axial portion.

7. The apparatus for oscillating a showerhead of claim 6 wherein said transducer means abuts a first side of said first cap and said first fluid chamber abuts a second side of said first cap.

8. An apparatus for oscillating a showerhead in a papermaking apparatus, comprising:

a hydraulic cylinder with a first port and a second port;

a driveshaft axially sliding within said hydraulic cylinder and extending therefrom, said driveshaft being coupled to the showerhead;

(a) magnetic means coupled to said driveshaft; and (b) magnetostrictive linear displacement transducer means for determining a position of said magnetic means and outputting a position signal;

(c) wherein said magnetic means is substantially free of wear surfaces associated with movement of said driveshaft;

means for selectively directing fluid from a pressurized source to a port chosen from said first port and said second port to urge said driveshaft in a direction chosen from an extending direction and a retracting direction, respectively, responsive to a direction control signal; and a control means for receiving said position signal from said transducer means, determining a desired direction of movement of said driveshaft, and outputting said direction control signal to said means for selectively directing fluid.

9. The apparatus of claim 8 wherein said transducer means further determines a rate of said magnet means and further outputs a rate signal and wherein said apparatus further includes a control means for receiving said rate signal from said transducer means, determining if said rate has dropped below a preset value, and outputting an alarm signal.

* * * * *